United States Patent [19]

Kinouchi et al.

[11] Patent Number: 4,781,635

[45] Date of Patent: Nov. 1, 1988

[54] MARINE OUTBOARD ENGINE UNIT

[75] Inventors: Sosuke Kinouchi, Kakogawa; Hideto Yoshitake, Akashi, both of Japan

[73] Assignee: Kawasaki Jukogyo Kabushiki Kaisha, Hyogo, Japan

[21] Appl. No.: 106,654

[22] Filed: Oct. 9, 1987

[30] Foreign Application Priority Data

Oct. 9, 1986 [JP] Japan ..... 61-155101[U]

[51] Int. Cl.[4] ..... B63H 21/28

[52] U.S. Cl. ..... 440/75; 440/900; 123/195 HC; 123/196 W

[58] Field of Search ..... 440/49, 50, 52, 75, 440/76, 77, 78, 88, 89, 900; 123/196 R, 196 W, 195 HC, 195 P, 195 E

[56] References Cited

U.S. PATENT DOCUMENTS 2,691,954 10/1954 Shively ..... 440/88

4,709,671 12/1987 Sumigawa ..... 123/196 W

FOREIGN PATENT DOCUMENTS 60-60097 4/1985 Japan .

*Primary Examiner*—Sherman D. Basinger

*Assistant Examiner*—Jesus D. Sotelo

*Attorney, Agent, or Firm*—Wenderoth, Lind & Ponack

[57] ABSTRACT

In a marine outboard engine unit driven by a four-stroke-cycle engine, the vertical crankshaft is aft of the cylinders and the camshaft and drives the camshaft via a sprocket-and-chain mechanism, the lower end of the camshaft being coupled to the extension drive shaft which is coupled to the propeller at the lower end of the lower unit, and the carburetor for each cylinder is at the forward part of the engine. By this arrangement, "oil rise" of the lubricating oil in the engine is prevented when the boat hull, under way, assumes a bow-up attitude, and the speed-reduction ratio from crankshaft to propeller can be reduced, whereby a high-speed, high-power-output engine can be used.

3 Claims, 2 Drawing Sheets

MARINE OUTBOARD ENGINE UNIT

BACKGROUND OF THE INVENTION

This invention relates generally to so-called marine "outboard motors" or marine outboard engine units each of which is a unit assembly of an internal-combustion engine, a power transmission mechanism, a screw or propeller, auxiliary devices, and a frame structure for supporting and holding together these parts. Such a unit assembly is hereinafter referred to as an "outboard engine". As is known, an outboard engine is dismountably mounted on the upper part of the transom of a boat hull or on some other stern part of the hull.

The above mentioned internal combustion engine in most outboard engines has been two-stroke-cycle gasoline engines, while others have been four-stroke-cycle gasoline engines, both types having one or more cylinders.

In an example of a known four-stroke-cycle engine (hereinafter referred to by the abbreviated term "four-cycle engine") used in an outboard engine, the crankshaft of the engine is in a forward position, that is, a position relatively near the stern of the boat hull when the outboard engine is in mounted state, while the camshaft is in an aft position, aft of the crankshaft. For this reason, when the boat hull is being driven, i.e., is under way, and assumes a bow-up attitude, the lubricating oil in the engine tends to move undesirably toward the cylinder head side of the engine, since the engine also tilts similarly as the hull. As a consequence, an undesirable "oil-rise" state arises.

Another typical feature of a known outboard engine is that the crankshaft of the engine is coupled directly to the extension drive shaft in the lower unit for driving the propeller via a bevel-gear speed-reduction mechanism functioning additionally to change the axis of rotation from vertical to horizontal. In general, the speed-reduction ratio of this mechanism is limited to a value of the order of ½ because of the necessity of restricting the bulk of the mechanism and its housing in order to reduce water resistance. Furthermore, the maximum rotational speed of the propeller is limited by the occurrence of cavitation.

As a consequence of the above described problems, the performance of a four-cycle engine in a conventional outboard engine has been unavoidably restricted by the necessity of keeping its rotational speed down, whereby it has not been possible to use a four-cycle engine of high-speed and high power output.

SUMMARY OF THE INVENTION

It is an object of this invention to provide a marine outboard engine in which occurrence of oil rise is prevented even when the boat hull assumes a bow-up attitude when it is under way, and which can satisfy the requirements for a marine outboard engine even when its engine is a four-cycle engine of high-speed, high-output type.

According to this invention, briefly summarized, there is provided, a marine outboard engine unit of the type having an aft part and a forward part for attachment to the stern of a boat hull and comprising a lower unit, a vertical extension drive shaft housed within the lower unit, a propeller coupled to the lower end of the drive shaft to be driven thereby, and an engine mounted on the upper part of the lower unit and adapted to drive the drive shaft, said engine being a four-stroke-cycle engine which has at least one cylinder and is characterized in that it has a vertical crankshaft at said aft part, at least one vertical camshaft which is disposed at said forward part and driven by power from the crankshaft via transmission means, and which is coupled to the upper end of the drive shaft to drive the same, and a carburetor provided for each cylinder and disposed at said forward part to face forwardly.

The nature, utility, and further features of this invention will be more clearly apparent from the following detailed description when read in conjunction with the accompanying drawings, briefly described below.

DETAILED DESCRIPTION

Figure 3:
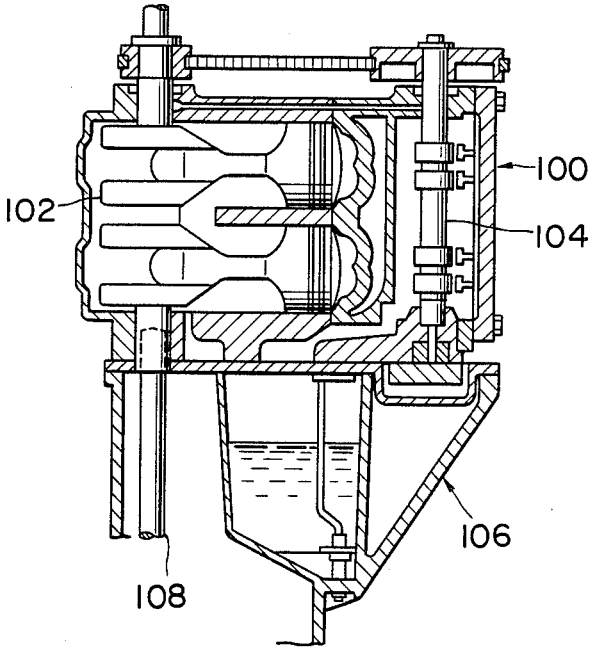
FIG. 3 PRIOR ART
FIG. 3 is an elevation, similar to FIG. 2, of one example of a known four-cycle engine used in a conventional marine outboard engine.

An conducive to a full understanding of this invention, the general nature, attendant problems, and limitations of the conventional outboard engine with a four-cycle engine will first be briefly described with respect to a typical example illustrated in FIG. 3 (and disclosed in Japanese Patent Laid-Open No. 60-60097 Published Apr. 6, 1985).

In this known outboard engine, the crankshaft 102 of the four-cycle engine 100 is disposed in a forward position, while the camshaft 104 is disposed in an aft position. For this reason, when the hull is under way and assumes a bow-up attitude, the lubricating oil tends to move excessively toward the cylinder head side of the four-cycle engine and gives rise to an "oil-rise" state.

Furthermore, the crankshaft 102 is coupled directly to the extension drive shaft 108 of the lower unit 106. In general, the speed-reduction ratio of the bevel-gear speed-reduction mechanism (designated by reference numeral 19 in FIG. 1) between the lower end of the drive shaft and the screw or propeller is selected at a value of the order of ½ in order to keep the diameter of the mechanism housing at a low value thereby to reduce the water resistance. Furthermore, an upper limit is imposed on the rotational speed of the propeller by the occurrence of cavitation. As a consequence, the operational performance of the four-cycle engine 100 has been unavoidably restricted by the necessary consideration of low speed, whereby it has not been possible to use a four-cycle engine 100 of high-speed and high power output.

Figure 1:
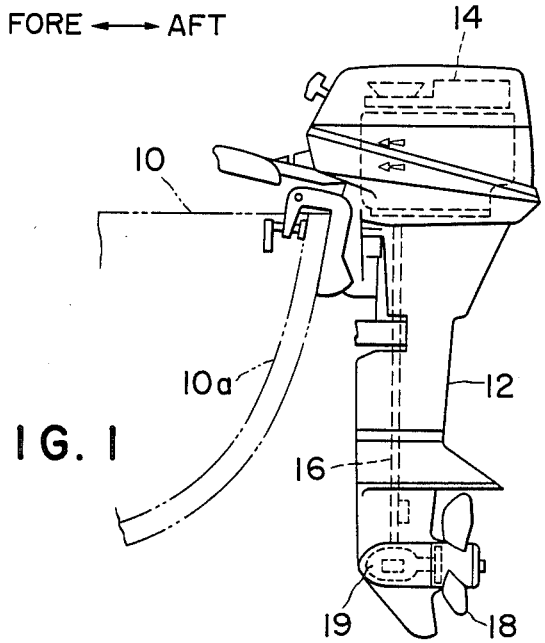
FIG. 1 is a port side elevation showing one example of the marine outboard engine according to this invention in mounted state on the transom of a boat hull.

Referring now to FIG. 1 showing a preferred embodiment of an outboard engine according to this invention, this outboard engine is detachably clamped to the transom 10*a* of a boat hull 10 and comprises, essentially a four-cycle engine 14, auxiliary parts thereof, and a lower unit 12 including an extension drive shaft 16, a bevel gear reduction mechanism 19 and a propeller 18.

Figure 2:
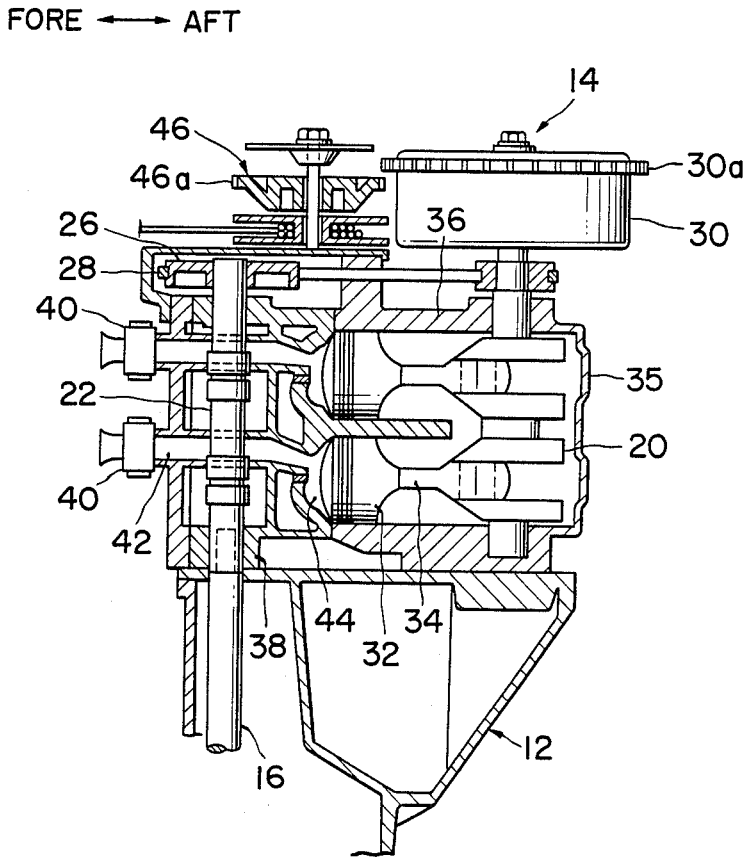
FIG. 2 is a port side elevation, in vertical section, showing an example of a four-cycle engine in the marine outboard engine illustrated in FIG. 1.

As shown in FIG. 2, the crankshaft 20 of the four-cycle engine 14 is disposed in an aft position with its rotational axis in a substantially vertical direction, while the camshaft 22 for timing control of the engine is disposed vertically in a forward position. To the upper ends of the crankshaft 20 and the camshaft 22 are fixed sprockets 24 and 26, which are meshed with an endless chain 28 wrapped therearound. The power output of the engine 14 is thus transmitted from the crankshaft 20 via the sprockets 24 and 26 and the chain 28 to the camshaft 22 as the rotational speed of the crankshaft 20 is reduced to one half.

In the embodiment illustrated in FIG. 2, the crankshaft 20 is driven in rotation by two pistons 32, 32 through connecting rods 34, 34. This four-cycle engine 14 is a high-output, high-speed type engine similar to a motorcycle engine.

The pistons 32, 32, connecting rods 34, 34, and the crankshaft 20 are housed within a cylinder block 36 including a crankcase 35 which functions as a reservoir for lubricating oil. The cylinder block 36 is fixed to the upper part of the lower unit 12. The upper end of the extension drive shaft 16 is coupled to the lower end of the camshaft 22 by a spline connection. At its forward side, the cylinder block 36 is covered by a cylinder head 38, between which and the cylinder block 36 combustion chambers 44, 44 are formed. These combustion chambers 44, 44 are supplied with a fuel-air mixture from respective carburetors 40, 40, disposed at the foremost part of the engine 14, via intake manifolds 42, 42.

A flywheel 30, having a moment of inertia substantially equal to that of a conventional outboard engine, is fixed to the upper end of the crankshaft 20 and is provided around its periphery with gear teeth 30*a*. A recoil starter 46 of known type is mounted on the upper part of the cylinder head 38 and is provided with a driving gear 46*a* which, at the time of starting, is caused to mesh with the gear teeth 30*a* of the flywheel engine 14.

The operational features of the outboard engine according to this invention will now be described.

In general, a four-cycle engine 14 for marine use is required to produce a high torque at low-speed. For this reason, the conventional engine 100 (FIG. 3) cannot be made to produce a very high output power (particularly at the time of trolling). In the case of the four-cycle engine 14 described above and illustrated in FIG. 2, however, since the engine power is outputted through the camshaft 22, whose rotational speed has been reduced to ½ that of the engine crankshaft 20, the power output characteristics transmitted to the drive shaft 16 will become optimal for an outboard engine as shown in the following Table 1 even if the engine 14 is adapted to be of high-output and high-speed type equivalent to that of an engine for a motorcycle.

TABLE 1

| Operational mode | Rotational speed, conventional outboard engine (rpm) | Rotational speed, engine of this invention (rpm) | Rotational speed, drive shaft of this invention (rpm) |
|---|---|---|---|
| Idling | 800 to 1,000 | 800 to 1,500 | 400 to 750 |
| Trolling | 400 to 600 | — | 400 to 750 |
| Max. Speed | 5,000 to 6,000 | 9,000 to 13,000 | 4,500 to 6,500 |

Furthermore, while the moment of inertia of the flywheel 30 is of the same order as that of a conventional outboard engine, the rotational speed of the flywheel 30 is double that of the conventional outboard engine, whereby fluctuation in rotational speed is greatly reduced.

Another advantageous feature afforded by this invention is that, since the carburetors 40 of the engine 14 are positioned to be in the vicinity of the boat hull 10 (FIG. 1), the installation of the control linkages and fuel system piping is facilitated, and, moreover, adjustment of the carburetors 40 from the stem of the hull 10 while the boat is under way can be easily and conveniently carried out.

Still another feature of this invention is that, when the boat is under way, and its hull 10 assumes a bow-up attitude, whereby the entire engine 14 also assumes an attitude wherein its forward part is raised relatively upward, the aft parts including the crankshaft 20 in the cylinder block 36, serving as a reservoir for the lubricating oil, conversely assume an aft-lowered state. Therefore, there is little possibility of occurrence of the aforementioned "oil-rise" state.

A further feature of this invention is that, the recoil starter 46 is mounted on the top of the cylinder head 38 near the hull 10 and forward of the flywheel 30 at a position to be engageable therewith. Therefore the space forward of the flywheel is effectively utilized, whereby the entire engine 14 can be made compact.

As has been described above, with respect to one example having two cylinders, in the marine outboard engine according to this invention, the crankshaft 20 of the four-cycle engine 14 is disposed parallelly relative to the lower unit 12 and at a position aft of the vertical camshaft 22, to which it is coupled. The lower end of the camshaft 22, which rotates at ½ the rotational speed of the crankshaft, is coupled to the upper end of the drive shaft 16 within the lower unit 12. The two cylinders in tandem inline arrangement of the engine 14 are provided with fuel-air mixture from respective carburetors 40, the air-intake ports of which face forward toward the stern of the hull 10. Thus, even when the engine 14 is adapted to deliver a high power output at high rotational speed equivalent to those of an engine for a motorcycle, the characteristics of the output power transmitted to the extension drive shaft 16 can be made to be optional for an outboard engine as shown in Table 1.

Since the carburetors 40 are provided to be in the vicinity of the boat hull 10, as shown in FIG. 1, the design and installation of the control linkages and fuel piping are facilitated. Moreover, the work of adjusting the carburetors 40 by a person at the stern of the hull 10 of the boat under way becomes easy and efficient.

Since the hull 10 assumes a bow-up attitude when the boat is under way, the entire engine 14 tilts aft, that is, its forward part also rises relative to its aft part. However, since the part of the cylinder block 36 on the crankshaft 20 side, in which the lubricating oil is stored, conversely dips in the aft direction, rising of the lubricating oil is prevented.

This invention is not limited to an outboard engine with a camshaft 22 of overhead type as illustrated in FIG. 2 but is applicable also to engines with camshafts of other types such as the side type in which the camshaft is on the side of the cylinder head or the type in which the camshaft is above the cylinders.

Furthermore, in the case of an outboard engine having two camshafts as in a double overhead camshaft engine, it is possible to transmit engine power from the crankshaft to one of the camshafts and to couple that camshaft to the other.

What is claimed is:

1. A marine outboard engine unit of the type having an aft part and a forward part for attachment to the stern of a boat hull and comprising a lower unit, a vertical extension drive shaft housed within the lower unit, a propeller coupled to the lower end of the drive shaft to be driven thereby, and an engine secured to the upper part of the lower unit and having an output shaft coupled to the upper end of the drive shaft to drive the same, the engine being a four-stroke-cycle engine having at least one cylinder, a vertical crankshaft disposed at said aft part, at least one vertical camshaft which is disposed at said forward part, is coupled to the crankshaft via transmission means to be driven by power from the crankshaft via the transmission means, and is coupled to the upper end of the drive shaft to drive the same, and a carburetor provided for each cylinder and disposed at said forward part to face forwardly.

2. A marine outboard engine unit as claimed in claim 1 further comprising a flywheel coupled to the upper part of the crankshaft and provided around the outer peripheral part thereof with driven gear teeth and a recoil starter mounted on said forward part and provided with driving gear teeth engageable with said driven gear teeth at the time of starting of the engine.

3. A marine outboard engine unit as claimed in claim 1 in which said transmission means comprises a driving sprocket fixed to and rotated by the crankshaft, a driven sprocket fixed to an rotating each camshaft, and an endless chain passed around and coupling the driving and driven sprockets.

* * * * *